United States Patent [19]

Woodward

[11] 4,031,539

[45] June 21, 1977

[54] BROADBAND TURNSTILE ANTENNA

[75] Inventor: Oakley McDonald Woodward, Princeton, N.J.

[73] Assignee: RCA Corporation, New York, N.Y.

[22] Filed: Dec. 11, 1975

[21] Appl. No.: 639,761

[52] U.S. Cl. ..... 343/797; 343/819; 343/846

[51] Int. Cl.² ..... H01Q 21/26

[58] Field of Search ..... 343/819, 797, 895, 846

[56] References Cited

UNITED STATES PATENTS

| | | | |
|---|---|---|---|
| 2,364,084 | 12/1944 | Martin | 343/797 |
| 2,485,138 | 10/1949 | Carter | 343/819 |
| 2,919,442 | 12/1959 | Nussbaum | 343/895 |
| 3,218,646 | 11/1965 | Ehrenspeck | 343/819 |
| 3,438,043 | 4/1969 | Ehrenspeck | 343/819 |
| 3,641,578 | 2/1972 | Spanos | 343/846 |
| 3,701,157 | 10/1972 | Uhrig | 343/797 |
| 3,725,943 | 4/1973 | Spanos | 343/797 |
| 3,811,127 | 5/1974 | Griffee et al. | 343/797 |
| 3,919,710 | 11/1975 | Fletcher | 343/797 |

FOREIGN PATENTS OR APPLICATIONS

| | | | |
|---|---|---|---|
| 593,796 | 3/1960 | Canada | 343/819 |

*Primary Examiner*—Harold A. Dixon

*Attorney, Agent, or Firm*—Edward J. Norton; Robert L. Troike

[57] ABSTRACT

A truncated conical member of conductive material is mounted forward of a pair of crossed dipoles, the legs of which are inclined toward a reflector. The pair of dipoles cross orthogonal to each other at the dipole centers with the dipole halves being fed with equal power in the relative phase rotation of 0°, 90°, 180° and 270°.

7 Claims, 5 Drawing Figures

BROADBAND TURNSTILE ANTENNA

BACKGROUND OF INVENTION

This invention relates to circularly polarized antennas and particularly to a turnstile antenna which provides a voltage standing wave ratio of 1.2 or less over a bandwidth of 1.24 to 1. This makes an antenna of this type suitable for use as an FM broadcast antenna. Reference is made to U.S. Pat. No. 3,725,943 to Spanos and 3,896,450 to Fitzroy et al for a discussion of prior art turnstile and cross-dipole antenna construction.

SUMMARY OF THE INVENTION

Briefly, a broadband turnstile antenna is provided including a pair of center fed dipoles crossing each other at their center feed points. The dipole halves are fed in the relative phase rotation of 0°, 90°, 180°, and 270°. The dipoles are mounted forward of a reflector surface. A conductive member is closely spaced forward of the dipoles overlapping the feed points of the dipoles and a substantial portion of the dipoles.

DESCRIPTION OF THE PREFERRED EMBODIMENT

Figure 1:
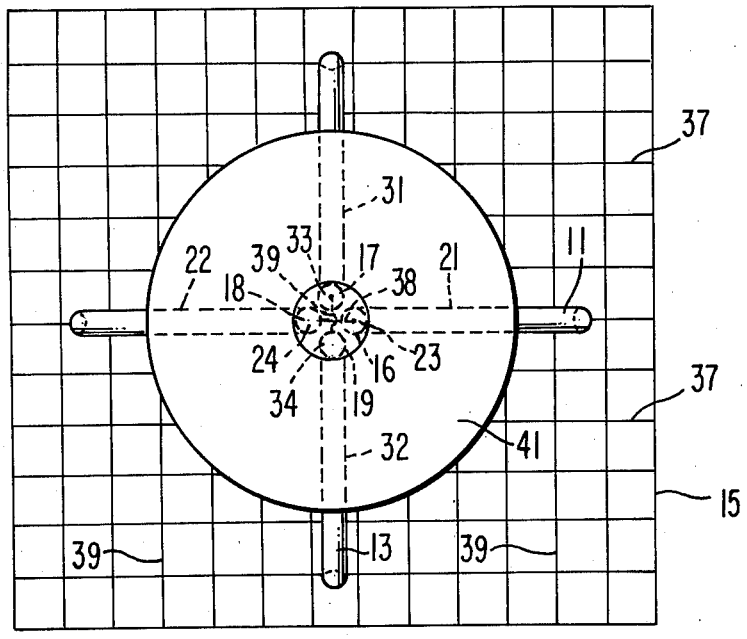
FIG. 1 is a top view of an antenna according to one embodiment of the present invention.
Figure 2:
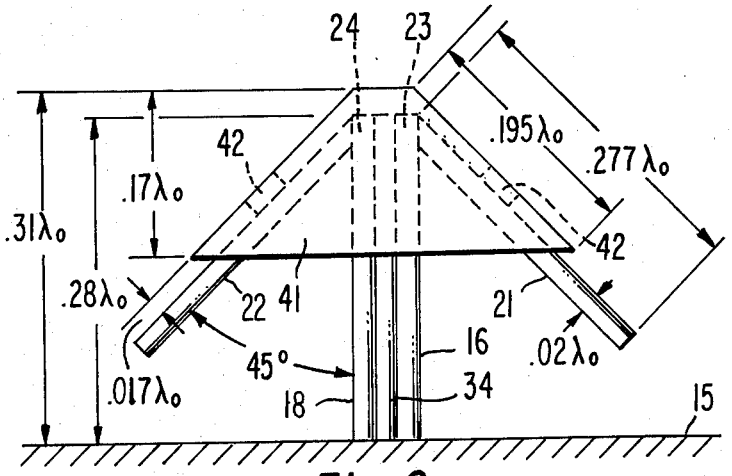
FIG. 2 is an elevation view of the antenna of FIG. 1 illustrating only one of the two crossed dipoles.

As shown in FIGS. 1 and 2, a circularly polarized antenna 10 includes a pair of crossed center fed dipoles 11 and 13 mounted forward of a reflector screen 15 by support legs 16 thru 19. The dipole 11 includes equal length dipole legs 21 and 22 that are spaced apart at the center feed point at the top ends 23 and 24 of support legs 16 and 18. The support legs 16 and 18 extend perpendicular and are mounted to the reflector screen 15. The dipole legs 21 and 22 extend from the top ends 23 and 24 of the respective support legs 16 and 18 toward the screen 15 at a 45° angle with respect to the support legs 16 and 18. Similarly, the dipole 13 includes equal length dipole legs 31 and 32 that are spaced apart at the center feed point at the top ends 33 and 34 of support legs 17 and 19. The support legs 17 and 19 extend perpendicular and are mounted to the reflector screen 15. The dipole legs 31 and 32 extend from the top ends 33 and 34 of the support legs 17 and 19 toward the screen 15 at a 45° angle with respect to these support legs. The screen 15 includes a network of horizontal rows of conductors 37 and vertical rows of conductors 39 in a conventional open mesh construction. While in the particular embodiment shown and described herein, the dipole legs are inclined at 45° to reduce the volume of the antenna, broadband operation can be obtained in other applications by the use of other angles.

Figure 3:
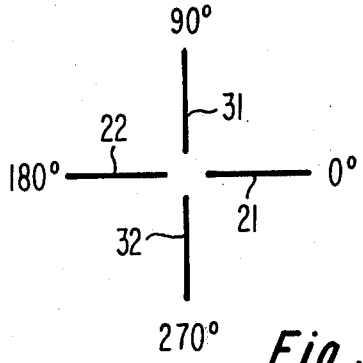
FIG. 3 illustrates the relative phase between the dipole legs in the arrangement of FIG. 1.

The dipole legs 21, 31, 22 and 32 as illustrated in FIG. 3 are fed at their ends in the relative phase rotation of 0, 90°, 180°, and 270° in the manner of a turnstile. The dipole legs 21 and 22 are fed 180° out of phase. This may be achieved by passing a coaxial transmission line up through a hollow support leg 16 with the outer conductor coupled to dipole leg 21 and the inner insulated conductor 38 connected to dipole leg 22. The dipole legs 31 and 32 are fed 180° out of phase. Likewise, a second coaxial transmission line may be passed through a hollow support leg 17 with the outer conductor coupled to dipole leg 31. The outer conductor of these coaxial feed lines may be the support leg. The inner conductor 39 of the second transmission line is insulated from the outer conductor and support leg 17 and is connected to dipole leg 32. Equal powered signals are coupled to the two coaxial transmission lines. These equal powered signals are coupled to the two lines with a relative phase difference of 90°. This equal power splitting and 90° relative phase shift may be achieved by a 3 db quadrature hybrid.

Broadbanding of the above described turnstile antenna is achieved by a truncated cone 41 of conductive material. The cone 41 as illustrated has conductive sides that extend at a 45° angle with respect to the support legs. The cone 41 extends in spaced relation over the crossed dipoles 11 and 13 over a major portion of the dipoles. The truncated part of the cone 41 is of conductive material that covers the feed point of the dipoles. For a given dipole height, cone size and spacing between the cone and the dipoles, the dipole legs are adjusted in length to give broadband impedance characteristics. For one preferred embodiment, the dimensions are as illustrated in FIG. 2. The dimensions are in midband wavelength $\lambda_o$. The height of the support legs is 0.28 $\lambda_o$ from screen 15. The dipole leg length is 0.277 $\lambda_o$, and the diameter of the dipole legs is 0.02 $\lambda_o$. The height of the cone 41 is about 0.17 $\lambda_o$. The length of the side of the cone 41 is 0.195 $\lambda$. The overall antenna height including the cone is 0.31 $\lambda_o$. The cone 41 is spaced 0.017 $\lambda_o$ from the dipole legs 21, 31, 22 and 32 by dielectric spacers 42 on these dipole legs.

Figure 4:
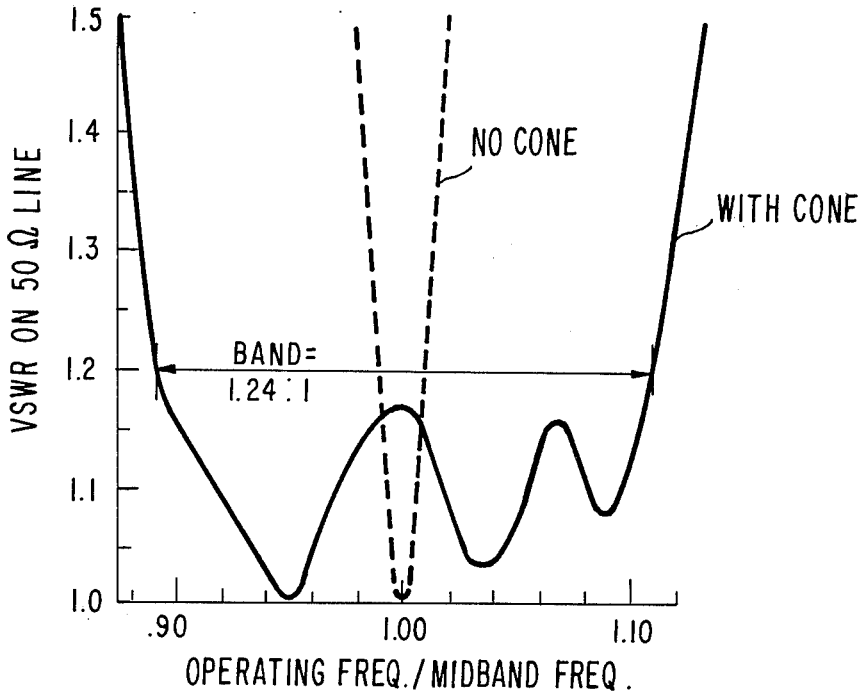
FIG. 4 is a plot of VSWR vs. ratio of operating frequency to midband frequency.
Figure 5:
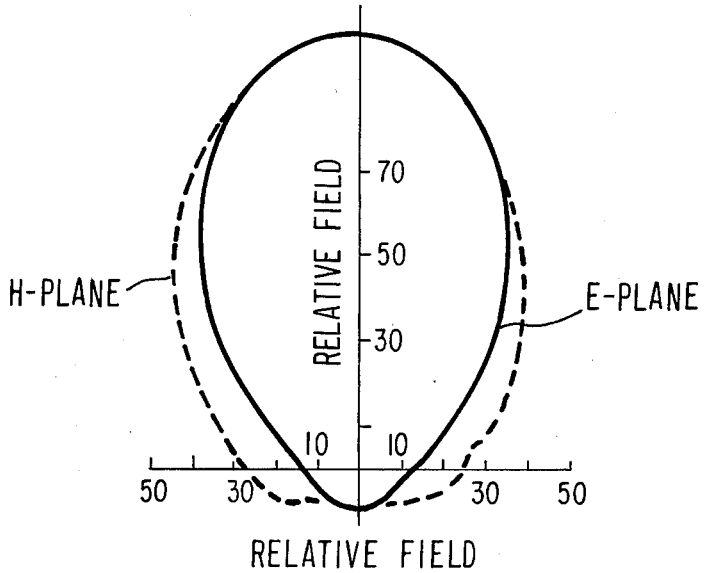
FIG. 5 illustrates typical E- and H- plane of radiation patterns at midband frequency.

An antenna as discussed above with and without the cone had the VSWR as plotted in FIG. 4. With the cone, as illustrated in FIG. 4, a maximum VSWR of 1.2 was provided over a 1.24:1 bandwidth ratio. The antenna also provided relatively good low axial ratio patterns as indicated by the nearly equal E- and H- plane, quadrature-fed, patterns of FIG. 5 over a wide angular region.

If desired for weather proofing, the cone may be of dielectric material that extends to the reflecting screen or panel at the flare angle described above. The inside surface of the dielectric cone is covered with conductive material with the conductive material stopping short of the screen and the full length of the dipoles.

What is claimed is:

1. A broadband turnstile antenna comprising:

a pair of crossed dipoles mounted forward of a reflective surface, said dipoles being center fed with the legs of the dipoles fed with equal power in the relative phase rotation of 0°, 90°, 180° and 270°, and a single member of conductive material closely spaced forward of said dipole legs and separated therefrom with said member overlapping the feed point of said dipoles and a substantial portion of said dipole legs.

2. The combination of claim 1 wherein said dipole legs are inclined toward said relfector, and said member is conically shaped.

3. The combination of claim 2 wherein said conically shaped member is a truncated cone with the truncated portion overlapping the feed point.

4. The combination of claim 2 wherein said member overlaps over one half of the length of the dipole legs.

5. A broadband turnstile antenna comprising:

a pair of crossed dipoles mounted forward of a flat reflecting screen, said dipoles having legs which are inclined toward said screen, said dipoles being center fed with the legs of the dipoles fed with equal power in the relative phase rotation of 0°, 90°, 180° and 270°, and a conically-shaped member of conductive material closely spaced forward of said dipole legs with said member overlapping the feed point of said dipoles and over one-half the length of the dipole legs.

6. The combination of claim 5 wherein said legs are inclined at an angle of 45° with respect to vertical supports for the dipole legs which supports extend perpendicular to said reflecting surface and the member is a truncated conically shaped member.

7. The combination of claim 6 wherein said dipole legs are approximately 0.277 $\lambda_o$ length long and 0.02 $\lambda_o$ in diameter, the side of the cone is 0.195 $\lambda_o$ long, is 0.17 $\lambda_o$ high and is spaced about 0.017 $\lambda_o$ from the dipole legs, the dipole legs are fed at a point about 0.28 $\lambda_o$ from the reflector surface and the end of the truncated portion of the cone is about 0.31 $\lambda_o$ from the reflecting surface, where $\lambda_o$ is a wavelength at the midband frequency of said antenna.

* * * * *